United States Patent [19]

Maria van Riet

[11] Patent Number: 4,637,189

[45] Date of Patent: Jan. 20, 1987

[54] THERMAL INSULATION SYSTEM

[75] Inventor: Wilhelmus A. Maria van Riet, Nieuw Beijerland, Netherlands

[73] Assignee: The Dow Chemical Company, Midland, Mich.

[21] Appl. No.: 704,829

[22] Filed: Feb. 25, 1985

[30] Foreign Application Priority Data

Feb. 24, 1984 [NL] Netherlands ..... 8400584

[51] Int. Cl.[4] ..... E04H 7/00

[52] U.S. Cl. ..... 52/309.8; 52/404; 52/519; 52/536; 52/248

[58] Field of Search ..... 52/519, 520, 521, 309.7, 52/309.8, 543, 544, 536, 522, 248, , 404; 220/437, 438, 439, 467, 468

[56] References Cited

U.S. PATENT DOCUMENTS

| | | | |
|---|---|---|---|
| 2,004,198 | 6/1935 | Fall | 52/536 |
| 2,323,297 | 7/1943 | Collins | 52/248 |
| 2,576,296 | 11/1951 | Green | 52/520 |
| 3,158,960 | 12/1964 | Newton | 52/522 |
| 3,214,876 | 11/1965 | Mattes | 52/522 |
| 3,456,835 | 7/1969 | Marcmann | 52/248 |
| 3,826,054 | 7/1974 | Culpepper | 52/309.8 |
| 4,163,347 | 8/1979 | Marcmann . | |
| 4,320,163 | 3/1982 | Kaufman | 52/309.8 |

FOREIGN PATENT DOCUMENTS

| | | | |
|---|---|---|---|
| 2641826 | 3/1978 | Fed. Rep. of Germany | 52/309.9 |
| 7704256 | 8/1978 | Netherlands . | |
| 720190 | 12/1954 | United Kingdom . | |

*Primary Examiner*—John E. Murtagh

[57] ABSTRACT

Thermal insulation is prepared from a series of insulative elements capable of being interconnected with each other, and a series of protective sheet elements which when fitted over the insulative elements protect the insulative elements from the environment.

10 Claims, 4 Drawing Figures

THERMAL INSULATION SYSTEM

BACKGROUND OF THE INVENTION

The present invention relates to a thermal insulation system and, more particularly, to a thermal insulation system comprising a series of interconnecting insulation elements and a series of protective sheet elements.

There are a variety of means to thermally insulate a building or other structure such as a storage tank. For example, to provide thermal insulation in a building which has generally flat outer wall surfaces, foam panels can be incorporated within or attached to the building walls. In the insulation of storage tanks and other structures having curved surfaces, a series of insulation panels or sheets are placed on the outside surface of the tank or other structure. Following installation of the insulation panels, the panels are then covered with metal sheets or plates which are mechanically fastened to each other such as by means of screws. Unfortunately, in the described system, the insulation panels and the insulated structure are not effectively protected from the environment, particularly water and/or moisture, by the protective metal plates. This reduces the effectiveness of the insulation panels in providing thermal insulation. More importantly, this can also lead to corrosion of the surface of the structure being insulated.

In an alternative method for insulating a storage tank or other structure having a curved surface, urethane foam forming components can be sprayed directly onto the surfaces of the storage tank or other structure and the foaming reaction allowed to take place in situ at the surface being insulated to prepare a foam insulation. However, expensive spraying equipment is required to insulate a tank using this procedure. Moreover, the application techniques are labor intensive and care is required in handling the urethane forming components.

In view of the deficiencies of the prior art for insulating storage tanks or other structures having a curved surface, it is desirable to provide an effective and simple thermal insulation system which can be employed for the insulation of storage tanks and other structures and which does not exhibit the aforementioned deficiencies.

Accordingly, the present invention is such a thermal insulation system. The thermal insulation system comprises a thermal insulation layer of a series of interconnecting insulation elements, each insulation element being generally rectangular in shape. All four edges of an individual insulation element are worked or cut such that an interconnecting network of the insulation elements can be prepared. The insulation elements possess a guide groove cut in a surface of the element or a guide groove formed at the joint between two adjacent insulation elements. The thermal insulation system further comprises a protective layer covering the insulation layer. The protective layer comprises a plurality of protective sheet elements which are generally rectangular in shape. The sheet elements are flanged on one edge with a simple flange and on the opposite edge with a grooved flange, the simple flange and grooved flange being designed such that the simple flange of one sheet element fits into the grooved flange of a second sheet element and the grooved flange of the sheet element fits into the guide groove of the insulation elements.

The thermal insulation system of the present invention which comprises two basic components (i.e., an insulative element and a protective sheet element) is effectively employed for thermally insulating storage tanks and other structures without using screws or similar fastening means. Both components are capable of being pre-manufactured before assembly of the insulation system, thereby providing ease of installation at minimum costs. In addition, the sheet elements effectively interconnect to provide mechanical support and to form a protective covering or layer over the insulation layer which protects the insulation layer from the environment without the labor intensive step of fastening each sheet element with, for example, screws.

With the above in mind, it is a primary object of the invention to provide an insulation system comprising a thermal insulation layer of a plurality of interconnecting insulation elements, each insulation element being generally reactangular in shape and having at least one guide grove provided in a major surface of the insulation element or formed at a joint of two adjacent elements, a plurality of individual insulation layer, and a protective layer covering the insulation layer, said protective layer comprising a plurality of sheet elements which are generally rectangular in shape, each sheet element having a flange at one end and a grooved flange at the opposite end; said grooved flange being designed such that when two insulation elements are interlocked together by the sheet element, the flange of one sheet element fits into the grooved flange of a second sheet element and the grooved flange fits into the guide groove of the insulation element.

Understanding of this invention will be facilitated by reference to the accompanying drawings (not to scale).

DESCRIPTION OF THE PREFERRED EMBODIMENT

Figure 1A:
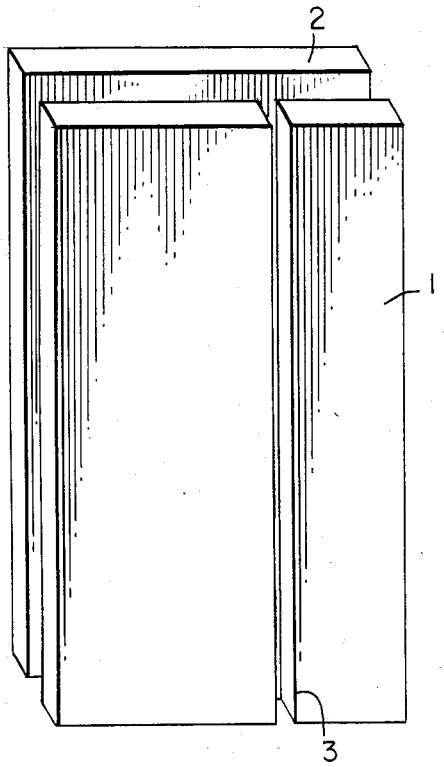
FIG. 1*a* is a schematic isometric representation of an illustrative insulating element advantageously employed in the insulation system of the present invention having a guide groove cut in the surface of the insulating element.

Referring now more particularly to the drawings, FIG. 1 depicts an insulation element or panel employed in the preparation of a thermal insulation layer. The insulation element 1 is generally rectangular in shape. The edges of the insulation element 1 are provided with a ship-lap cut 2 extending on opposite faces of the insulating element along the length and the width thereof. Although the insulation element of the present invention is preferably provided with a ship-lap cut, as illustrated in FIG. 1, the insulation elements can also be cut or worked in any manner to provide, e.g., a tongue and groove or butt edges. A groove or indentation 3 for guiding a flange of a protective sheet element extends into and along a major surface of the insulation element 1. The groove 3 can be of a variety of sizes and shapes depending on the application of the insulation and the specific protective sheet element employed in combination with the insulation element. In general, as depicted in FIG. 1*a*, the groove is advantageously rectangular in cross-section.

Figure 1B:
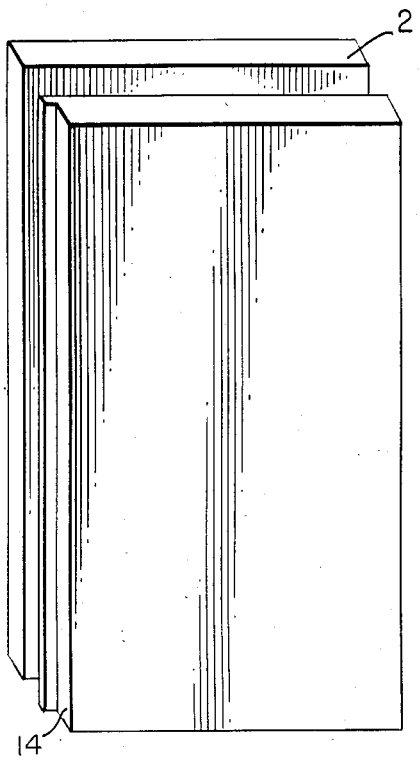
FIG. 1*b* is a schematic isometric representation of an alternative insulating element useful in the present invention.

FIG. 1*b* depicts an alternative insulation element similar to the insulation element depicted in FIG. 1*a* except that the guide groove is provided by cutting away a portion of ship-lap cut 2 at one edge of the insulation element to form an open groove 14. In this manner, the guide groove is positioned at the joint of two adjacent insulation elements. Although the preparation of an insulation element having a guide groove at the joint such as depicted in FIG. 1*b* is generally more easily fabricated, an insulation element having a guide groove positioned away from the joint such as depicted in FIG. 1*a* is more preferred due to the greater protection provided thereby.

Although the insulation elements are depicted in FIGS. 1(*a*) and (*b*) as having a single guide groove or channel 3 or 14, to further protect the surface of the insulation structure from the environment, the insulation elements can be prepared with a multitude of grooves. Specifically, additional grooves or joints provide a path for the "run-off" of any water forming behind the protective sheet elements without exposing the joints to the water thereby further reducing the risk of corrosion to the insulation system. The number, shape and size of the groove(s) or channel(s) most advantageously employed in the practice of the invention can vary depending on the specific insulation and protective sheet elements employed and is determined for each specific end use application. In general, each insulation element is preferably provided with from 1 to 3 grooves or channels. More preferably, the insulation element comprises two grooves or channels, one guide groove and one "run-off" groove.

Figure 2:
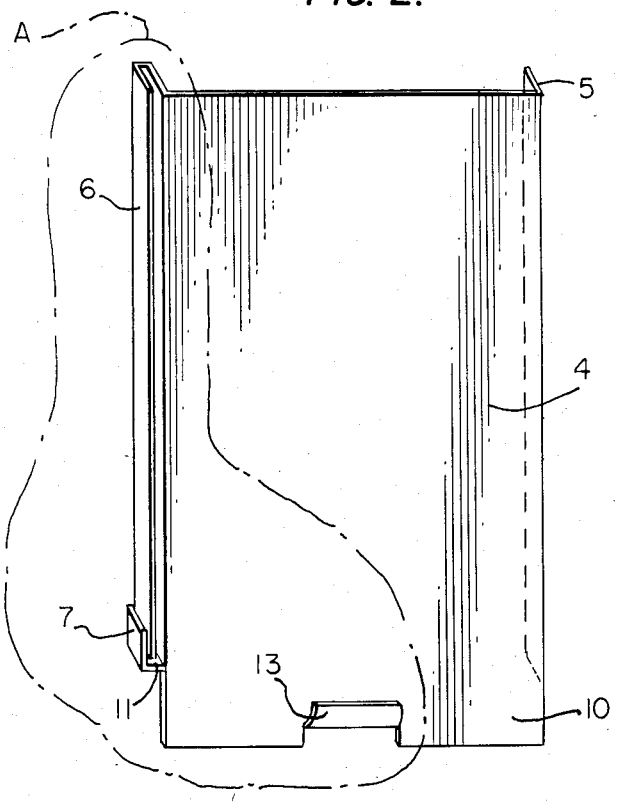
FIG. 2 is a schematic isometric repesentation of an illustrative protective sheet element advantageously employed in the insulating system of the present invention. The sheet element, in combination with the insulative element of FIG. 1, providing the insulation system of the invention for insulation of storage tanks or other structures.
Figure 4:
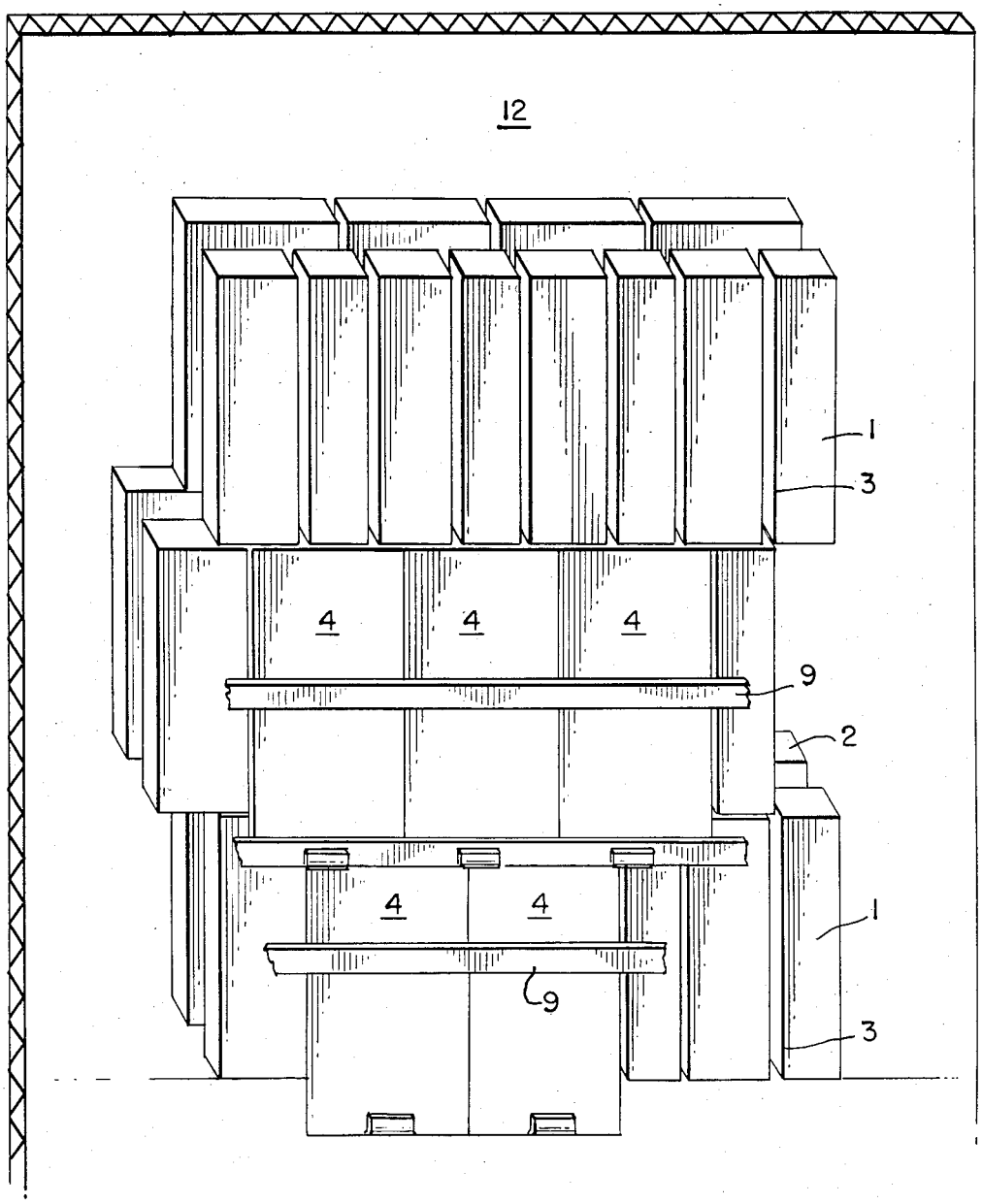
FIG. 4 is a schematic isometric representation of the manner in which the insulating and protective sheet elements are employed in the preparation of a thermal insulation system of the invention.

FIG. 2 depicts a protective sheet element 4 used in preparing the protective layer of the thermal insulation system of the present invention. The sheet element 4 is usefully employed in combination with the insulation element depicted in FIGS. 1(*a*) or (*b*) for assembling of the thermal insulation system. The sheet element has a simple flange 5 along one edge having a length equal to or slightly less than the length of a major surface of the insulation element. On the opposite edge of the sheet element 4 is a grooved flange 6, extending in the same direction and having approximately the same length as the simple flange 5. The width of the grooved flange corresponds to the guide groove 3 of an insulation panel 1 and to the length of the flange 5. In the embodiment depicted in FIG. 2, a portion of the sheet extends beyond the ends of flanges 5 and 6 to form a skirt portion 10. An edge portion of the skirt portion 10 is cut-out to form a securing element 13 which is adapted to be turned up over the skirt portion to engage a fastening strap to thus secure or affix the sheet element 4 to the strap (as shown in FIG. 4).

Figure 3:
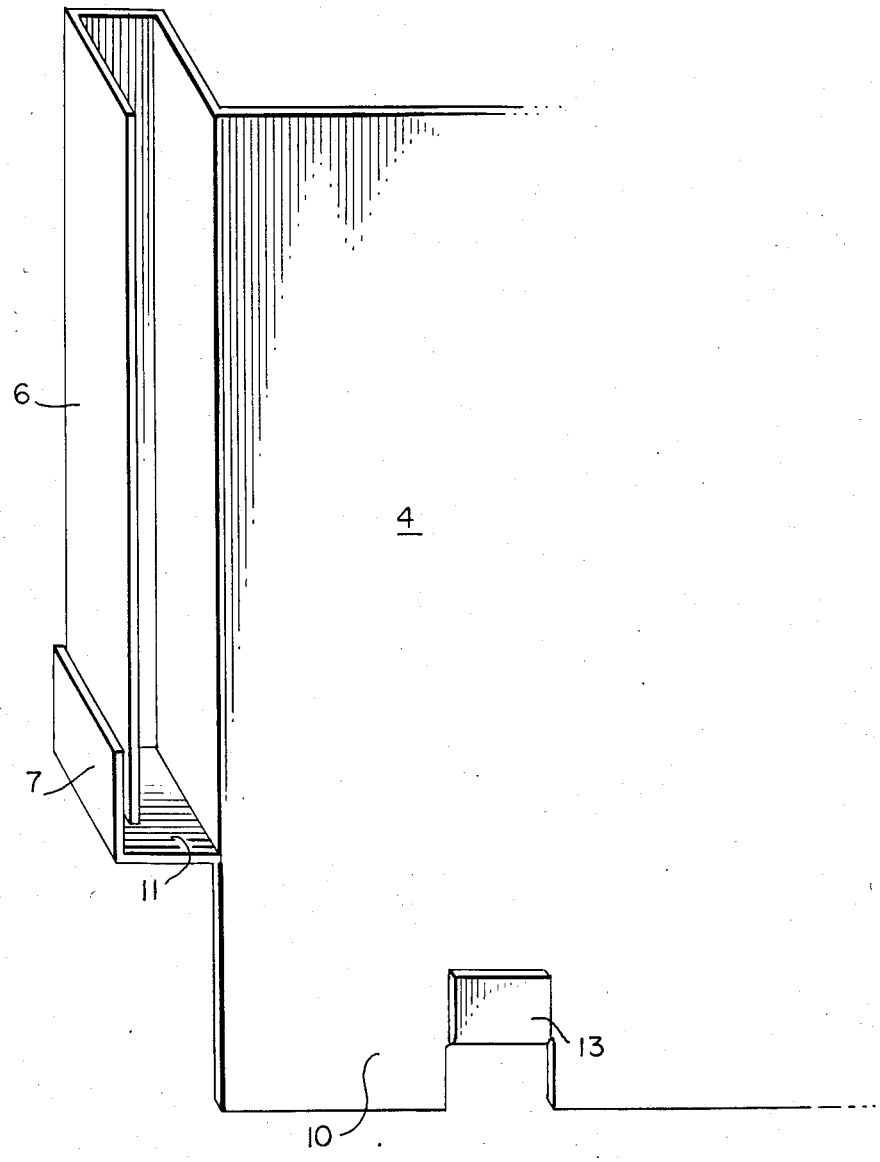
FIG. 3 is a schematic isometric representation of a portion, indicated by letter A, of a protective sheet element depicted in FIG. 2.

Although the grooved flange 6 can be formed to provide two open ends, for maximum protection of the insulation elements 1 from water, as depicted in detail in FIG. 3, the lower end of grooved flange 6 is advantageously closed such that water entering the grooved flange 6 runs through a channel formed by the grooved flange to the closed end and out the channel to the environment. As depicted in FIG. 3, the end of the channel is formed by a closure element 7 having a base portion 11. The closure element is easily formed by bending element 7 back over itself until it rests against the outer surface of grooved flange 6. Preferably, the base 11 portion of the closure element 7 is formed such that it slopes outwardly from the base of the channel to the environment. In this manner, any water entering the grooved flange 6 will run through the channel to base portion 11 and subsequently flow to the environment.

The dimensions and shape of both the insulation and sheet elements are dependent on a variety of factors including the specific materials used in preparing the insulation and sheet elements, the structure to be insulated therewith and the desired thermal insulative effect.

In general, the sheet element is prepared such that the flanges are of equal length and of a length equal to the individual insulation elements to be covered by the sheet element. In addition, the width of the grooved flange is preferably approximately equal to the width of the groove in the insulation element and of the same depth as said groove. In addition, the sheet elements are prepared such that the simple flange of one sheet element will snugly fit into the grooved flange of an adjacent sheet element. For ease of construction, the grooved flange of the sheet element as well as the guide groove of the insulation element are both rectangular in shape. However, other shapes can also suitably be employed provided the grooved flange fits snugly into the guide groove.

In general, the sheet element is designed having the same width as the insulation element so that although one sheet element covers a portion of adjacent insulation elements in the same row, one sheet element is employed, on the average, for each insulation element. However, the sheet element can be designed to cover more than two, or a portion of two, adjacent insulation elements, provided, of course, that the element can be sufficiently curved to conform generally to the tank or other structure being insulated.

The thermal insulation system formed from the described insulation elements 1 and protective sheet elements 4 is composed of multiple rows of a plurality of insulation elements with each row of insulation elements being covered by a row of a plurality of protective sheet elements 4. A typical use of the insulation element 1, as illustrated in FIG. 1*a*, and sheet element 4 in preparing a thermal insulation system is depicted in FIG. 4 in which a partially assembled thermal insulation system is formed from a plurality of insulation and sheet elements 1 and 4 on the outer surface 12 of a storage tank 8, or other structure.

In the embodiment illustrated in FIG. 4, the insulation elements 1 are positioned against the surface 12 in an interconnecting pattern and are covered by the protective sheet elements 4. Specifically, the simple flange of one sheet element 4 is deposed in the grooved flange of an adjacent sheet element and their combination is snugly fit into the groove 3 of adjacent insulation elements 1. The skirt portion 10 extends beyond the ends of the flanges and covers a portion of a lower row of the insulation and sheet elements. Each row of insulation and sheet elements is mechanically fastened such as by one or more metal fastening straps 9 or other suitable means. As shown in FIG. 4, a portion of the skirt 10 of each sheet element is turned up to provide the securing element 13 (to affix the fastening strap 9 to the protective element 4) which is bent over the metal fastening strap 9 to firmly position the strap around the series or row of sheet elements.

In the thermal insulation system of FIG. 4, the horizontal joints of the adjacent layers or rows of insulation elements 1 are protected by the skirt portions 10 of the sheet elements 4. The vertical joints of each row of insulation elements 1 are protected by the surface itself of the sheet elements 4.

In addition, to further protect the insulation system from the environment, the insulation and sheet elements of each row are advantageously not aligned with respect to the insulation elements of an adjacent row. More particularly, the guide groove of any one insulation element is not directly aligned with the guide groove of an adjacent insulation element. In such manner, once the insulation system has been installed, any water or other liquid which falls into the channels, formed by the grooved flanges 6, of the sheet elements is effectively drained off to the environment and does not fall into the channel of an adjacent insulation element.

The thermal insulation system illustrated in FIG. 4 is prepared by building up a plurality of rows of the insulation and sheet elements in a step wise manner. For example, in one embodiment for thermally insulating a storage tank, a strap, preferably an extendable or elastic strap, is placed around the tank wall and individual insulation elements 1 are then positioned adjacent one another inside of the elastic strap. Although the overlapping skirt portion provides protection to the lateral or horizontal joint of the insulation elements and the sheet element itself provides protection against the environment to the vertical joint of the insulation elements, if it is absolutely essential that no moisture or other environmental influence can be tolerated by the insulation elements, they may be glued to the tank and to each other prior to covering by the sheet element. The sheet elements are placed over adjacent insulation elements in a manner such that the flanges of adjacent sheet elements fit snugly into one another and into the guide grooves of two adjacent insulation elements. The procedure is repeated until a layer or row of insulation elements covered by the sheet elements is prepared. Subsequently, the row or layer is permanently secured by mechanical means such as by tightening the metal strap 9 around the row or layer of insulation and sheet elements.

A second row or layer of insulation and sheet elements can now be assembled in the same manner. The insulation and sheet elements of this second row are preferably off-set so that the grooves of the second row are not aligned with the grooves in the first row. Subsequently, the second row of insulation and sheet elements are fastened securely using the metal strap. The procedure is repeated until the entire structure has been insulated.

Placement of the sheet elements over the insulation elements can be conducted in a variety of ways such as by placing the sheet elements coincident with the placement of adjacent insulation elements, i.e., a sheet element is positioned immediately following the placement of any two insulation elements, or can be delayed until after the preparation of a complete row of insulation elements is formed or even until insulation elements are placed around the entire tank prior to placement of the sheet elements.

With regard to the individual components of the present invention, the insulation element is advantageously a structural panel, generally rectangular in shape, of a material capable of providing thermal insulation. In general, such materials are foams which possess some compressive strength and in which a guide groove can be cut. The foams may be flexible, rigid or semi-rigid. Advantageously, the foams are cellular plastic foams, including thermoplastic and thermosettable cellular plastic foams, having an open or closed cell structure. Such cellular plastic foams are well-known in the art and reference is made thereto for the purposes of this invention. Representative of such foams include foams derived from styrene or styrene and one or more monomers copolymerizable therewith such as an acrylic acid or a-methylstyrene (e.g.,polystyrene expanded bead board and expanded, closed-cell polystyrene foam); polyurethane or isocyanurate modified polyurethane foams, polyvinylchloride foams and foams prepared from the reaction product of urea or phenol with formaldehyde. In addition, foamed glass can also advantageously be employed herein. Due to its superior insulating properties and its resistance to absorption of moisture, a closed cell polystyrene foam is preferably employed herein.

The protective sheet elements are generally thin sheet materials which are constructed in the desired form. For example, metal (e.g., aluminum or stainless steel) sheets can be employed for the construction of the sheet elements. Alternatively, the sheet elements can be prepared from a plastic material using conventional techniques such as injection molding techniques. Suitable materials for forming the protective elements are those which provide the necessary protection to the underlying insulation and which themselves are sufficiently resistant to the environment. In general, metals are employed. Aluminum and stainless steel are preferred. Suitable plastic materials include polyethylene, polypropylene, ABS resins, polyvinylchloride or the like.

I claim:

1. An insulation system suitable for insulating a storage tank having a curved surface without using screws, which comprises a thermal insulation layer of a plurality of interconnecting insulation elements, each insulation element being generally rectangular in shape and having at least one guide groove provided in a major surface of the insulation element or formed at a joint of two adjacent elements, a plurality of individual insulation elements are arranged to provide an interconnecting network of insulative elements forming said insulation layer, and a protective layer covering the insulation layer, said protective layer comprising a plurality of sheet elements which are generally rectangular in shape, each sheet element having a flange at one end and a grooved flange at the opposite end; said grooved flange being designed such that when two insulation elements are interlocked together by the sheet element, the flange of one sheet element fits into the grooved flange of a second sheet element and the grooved flange fits into the guide groove of the insulation element; at least one fastening strap securing the insulation and sheet elements; and wherein the grooved flange of the sheet element is closed at one end; the closed end being inclined whereby water will flow outwardly from the grooved flange.

2. The insulation system of claim 1 wherein the insulation layer comprises a plurality of rows of insulation elements with each row of insulation elements being covered by a row of sheet elements.

3. The insulation system of claim 1 wherein the width of the insulation and sheet elements are the same, and wherein the length of the sheet elements is at most equal to the length of the insulation elements.

4. The insulation system of claim 1 wherein the flanges of the sheet element have the same length as the major surface of the insulation element.

5. The insulation system of claim 1 wherein the sheet element has a skirt portion extending below the flanged portion of the sheet element to cover a portion of an adjacent insulation and sheet element.

6. The insulation system of claim 5 wherein a securing element is provided on the sheet element by turning up a portion of the skirt portion over the fastening strap.

7. The insulation system of claim 1 wherein the insulation element is prepared from a synthetic resinous foam material.

8. The insulation system of claim 6 wherein the foam material is a rigid or semi-rigid foamed plastic material selected from the group consisting of polystyrene, polyurethane and an isocyanuarate modified polyurethane foam.

9. The insulation system of claim 8 wherein the insulative material is a closed cell polystyrene.

10. The insulation system of claim 1 wherein the sheet element is a metal or plastic sheet.

* * * * *

UNITED STATES PATENT AND TRADEMARK OFFICE

CERTIFICATE OF CORRECTION

PATENT NO. : 4,637,189

DATED : January 20, 1987

INVENTOR(S) : Wilhelmus A Maria van Riet

It is certified that error appears in the above-identified patent and that said Letters Patent is hereby corrected as shown below:

Column 8, Claim 8, line 7, "claim 6" should read --claim 7--.

Signed and Sealed this

Seventh Day of June, 1988

*Attest:*

DONALD J. QUIGG

*Attesting Officer*

*Commissioner of Patents and Trademarks*